United States Patent [19]

Kelm

[11] 4,015,708

[45] Apr. 5, 1977

[54] BUTTON CELL STORAGE AND MERCHANDISING PACKAGE

[75] Inventor: Roger William Kelm, New Richmond, Wis.

[73] Assignee: Gould Inc., Rolling Meadow, Ill.

[22] Filed: Nov. 21, 1975

[21] Appl. No.: 634,070

[52] U.S. Cl. ..... 206/333; 206/460; 206/472; 206/820

[51] Int. Cl.[2] ..... B65D 73/02; B65D 85/58

[58] Field of Search ..... 206/333, 329, 328, 330, 206/331, 460, 472, 820, .83, .84, 37, 38; 229/92.9

[56] References Cited

UNITED STATES PATENTS

| | | | |
|---|---|---|---|
| 2,001,798 | 5/1935 | Schreiber | 206/813 |
| 2,019,267 | 10/1935 | Mink | 206/337 |
| 2,962,161 | 11/1960 | Lacy | 206/329 |
| 3,047,144 | 7/1962 | Wissel | 206/460 |
| 3,237,761 | 3/1966 | Madden | 206/331 |
| 3,433,351 | 3/1969 | Zaborney | 206/333 |
| 3,608,711 | 9/1971 | Wiesler et al. | 206/330 |
| 3,712,695 | 1/1973 | Kaye | 206/333 |

*Primary Examiner*—William T. Dixson, Jr.
*Attorney, Agent, or Firm*—Leydig, Voit, Osann, Mayer & Holt, Ltd.

[57] ABSTRACT

A storage and merchandising display package for button cells in which the cells are inserted in apertures and adhesively held against a backing material which, in the preferred embodiment, for Zinc-Air cells, has preferential barrier properties to extend the shelf-life of the cells. The package includes an openable cover which surrounds the cells to prevent accidental shorting or physical dislodgment thereof and which may also carry instructions as well as product or company identifying indicia thereon to enhance the sales appeal of the package and also serve as a product locator. The package may also be formed of absorbent material or material impregnated with an electrolyte neutralizing agent to prevent electrolyte leaking from the cells from damaging adjacent packages.

9 Claims, 3 Drawing Figures

BUTTON CELL STORAGE AND MERCHANDISING PACKAGE

Figure 1:
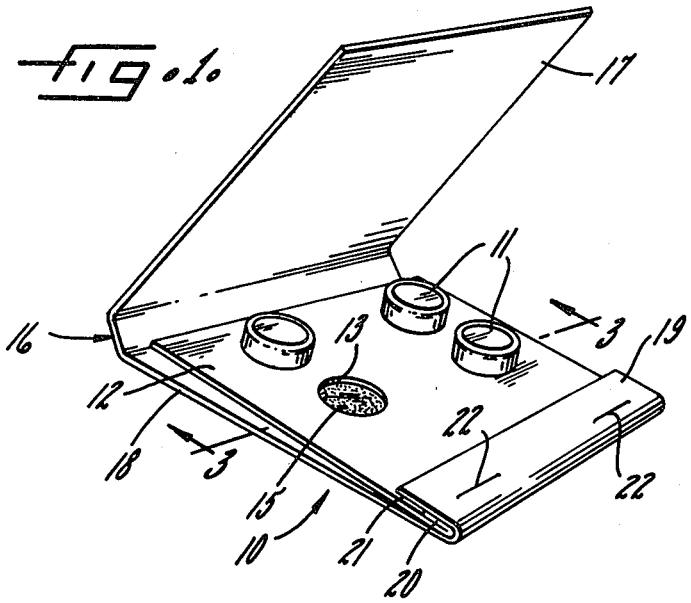

The present invention relates to the packaging of electrical cells in general and more particularly concerns a storage and merchandising package for button cells.

With the rising usage of button cells in hearing aids, transistor radios, miniature electronic calculators and the like, it has become increasingly important to provide economical packaging systems for adequately storing and effectively merchandising such cells for original equipment or replacement purchasers. This is especially true for such button cells, of the Zinc-Air cell type, which require air vents for proper operation and yet which must be substantially completely sealed during storage to insure adequate shelf-life. Due to the small size of such button cells it is also desirable to store and merchandise them in packages of a convenient size and construction so that the cells will not become inadvertently disassociated from their package and lost during transportation from the manufacturer to the retail outlet or subsequently by the purchaser who must transport them to another location for installation and use.

Accordingly, it is the primary aim of the present invention to provide a simple, economical and convenient package for button cells which is effective for storing and transporting such cells from point of manufacture, through normal sales distribution channels, to point of end use.

It is also an object to provide a package of the above type which also doubles as an effective and appealing merchandising display container, especially at the retail sales level, and which further serves as a readily identifiable product locator even after placed in the hands of the end user.

A more detailed object of the invention is to provide such a package including barrier properties for sealing vented button cells to prevent loss of capacity and performance during storage and thereby insure adequate shelf-life for the cells, not only during normal distribution and marketing; but, also, thereafter in the hands of the customer.

A further and more specific object is to provide a storage and merchandising package for button cells as described above which is inexpensively made of a laminate of materials including exposed areas of adhesive which materials together are effective to retain the cells in the package against accidental shorting or dislodgment and to provide the requisite barrier properties for vented button cells and yet from which the cells can be conveniently removed with the adhesive stripped free to prevent subsequent contamination of electrical contact surfaces or blockage of the cell vents.

Another object is to form such a button cell package with blotter-like constituents to absorb electrolyte which may leak from the cells or to impregnate the package material with an electrolyte neutralizing agent to prevent electrolyte leakage from the damaging adjacent packages.

Figure 2:
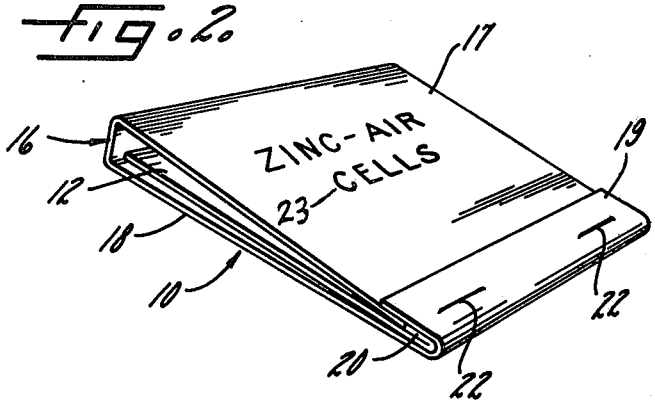
Figure 3:
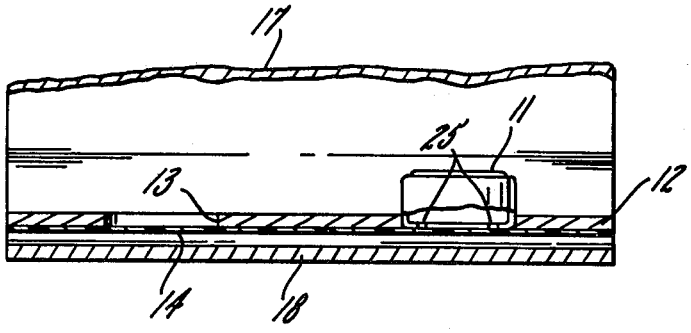

Other objects and advantages of the invention will become apparent upon reading the following detailed description and upon reference to the drawings, in which:

FIGS. 1 and 2 are perspective views of a storage and merchandising package for button cells, respectively, in open and closed positions; and, FIG. 3 is an enlarged fragmentary cross-section view seen substantially in the plane of line 3—3 in FIG. 1.

While the invention will be disclosed in connection with certain preferred embodiments, it will be understood that I do not intend to limit the invention to those embodiments. On the contrary, I intend to cover all alternatives, modifications and equivalents as may be included within the spirit and scope of the invention as defined by the appended claims.

Turning now to the drawings, there is illustrated a preferred form of a storage and merchandising package 10 for button cells 11 which embodies the present invention. Broadly speaking, the package 10 includes a substantially flat first layer of material 12 having a plurality of apertures 13 therein which are dimensioned to receive respective ones of the button cells 11. In the present instance the button cells 11 are of the conventional squat cylindrical configuration and the apertures 13 are circular. It will be appreciated, however, that if other shapes of cells were to be packaged, the apertures would be shaped and dimensioned accordingly.

For releasably retaining the button cells 11 in the apertures 13, a second layer of backing material 14 is laminated to the first layer 12 with pressure sensitive adhesive 15 on the backing material 14 exposed in the areas underlying the apertures 13 (see FIG. 1). It will be understood, of course, that during packaging, the button cells 11 are physically inserted in the apertures 13 and firmly pressed against the exposed pressure sensitive adhesive areas 15 on the backing material 14. When it is desired to remove a cell 11 from the package 10, they are simply peeled away from the adhesive 15 and lifted out of the apertures 13 as for example by grasping the package 10 in one hand and the cell 11 in the fingers of the other hand.

In the preferred embodiment, the backing material 14 is a thin plastic film of a polyester type such as "Mylar" sold by E. I. duPont de Nemours. It has been found that such a Mylar film having a thickness on the order of 2 mils in satisfactory for the backing material 14 and also possesses desirable barrier qualities as will be discussed hereafter. The adhesive 15 is preferably a silicon base type such as either No. 8402 or No. 8403 sold by The Minnesota Mining and Manufacturing Co. (3M Co.) but it may also be either a rubber or acrylic base type as, for example, No. 854 (rubber base adhesive) or No. 850 (acrylic base adhesive) also sold by The 3M Co. Since the backing layer 14 is relatively thin, it is normally quite flexible.

To prevent excessive flexing of the backing material 14, particularly in the apertures 13 or window areas, the first layer 12 is preferably made of relatively rigid material, such as card stock, to thereby stiffen the backing material 14. This substantially precludes warpage of the backing material 14 which tends to separate the exposed adhesive areas 15 from the button cells 11. Moreover, the first layer 12 and/or the backing material 14 may be formed of a blotter-like material to absorb electrolyte which may leak from the cells 11. Alternatively, the materials of the package 10 may be impregnated with an electrolyte neutralizing agent, such as boric acid, to neutralize electrolyte leakage and thus prevent damage to adjacent packages, display shelves or storage containers.

In order to prevent accidental electrical shorting or physical dislodgment of the cells 11 from the apertures 13, the package 10 is provided with a protective cover 16. If desired, the cover 16 may be formed of absorbent material and/or impregnated with an electrolyte neutralizing agent as discussed above. As shown in FIGS. 1 and 2, the cover 16 has a front panel 17 folded back from one end of the first layer 12 in overlying relation and a back panel 18 underlying the second layer 14. To releasably anchor the free edge of the front panel 17, a portion 19 of the back panel 18 is reversely folded over a shorter reversely folded over portion 20 of the first layer 12 to form a slot-like recess 21 for reception of the free edge of the front panel. These reversely folded portions 19 and 20 may be secured together by suitable fasteners such as wire staples 22 or the like. In the preferred embodiment the cover 16 carries identifying indicia 23 thereon such as a company name, logo, instructions, or product designation. Such indicia, of course, is helpful in effectively merchandising the button cells 11 and also serves as a handy product locator after the package 10 has been placed in the hands of the end user.

Pursuant to a further aspect of the present invention, the package 10 is also provided with preferential barrier properties to substantially completely seal the cell and to enhance the shelf-like of button cells 11 such as those of the Zinc-Air cell type which require air vents 25 (see FIG. 3) for proper operation but which must be substantially completely sealed during storage. As will be appreciated by those skilled in the art, Zinc-Air cells during storage can lose capacity and performance when exposed to air due to the occurrence of several different reactions. Thus oxygen in the air entering the cell through the vent holes 25 can react with the zinc and convert it to inactive zinc oxide. Also, carbon dioxide entering the cell 11 will react with the alkaline electrolyte to form carbonates and bicarbonates thereby causing a reduction in cell performance.

Water transfer into or out of the cell can also produce cell deterioration. Zinc-Air cells normally use an electrolyte where the water vapor pressure is equivalent to about 50% relative humidity. If the atmospheric relative humidity is higher than over the electrolyte, water will be transferred through the vent 25 and if this continues, the cell 11 will eventually fill with water with resultant loss of performance. Conversely, if the external relative humidity is lower, water will transfer out and the cell will dry out. This will not only cause an initial loss of performance due to insufficient electrolyte, but also, will result in direct oxidation of the zinc at a high rate due to the lack of electrolyte diffusion barrier to limit this reaction.

Even in cells 11 in which inhibitors have been applied to the zinc electrode, there is some reaction of the zinc with the water in the electrolyte to form hydrogen and zinc oxides and hydroxides. Thus small amounts of hydrogen are normally generated within the cell. In time, however, since this reaction breaks down the water in the electrolyte, the cell dries out direct oxidation of the zinc proceeds at increasing rates.

As previously mentioned herein, the preferred backing material 14 is a Mylar polyester film having a thickness on the order of 2 mils. This material has desirable preferential barrier properties in that it permits the transmission of hydrogen at low rates and is substantially impervious to oxygen, carbon dioxide and moisture, in that the transfer of these components is reduced to acceptably low rates. Referring again to the drawing, it will be seen that the cells 11 are pushed into the apertures 13 and against the adhesive 15 on the backing material 14 such that the vents 25 are covered. Since this backing material 14 permits the egress of hydrogen at low rates, pressure does not build up in the cell 11 to a level which would separate it from the adhesive. Moreover, the barrier properties of the backing material 14—being substantially impervious to oxygen, carbon dioxide and moisture prevents their ingress into the cell—substantially extends the shelf-life of the cells 11 stored in the package 10.

It should also be appreciated that the adhesive itself can serve as the barrier member. In that case the backing material 14 can be made of a gas permeable material such as another layer of paper board or card stock material similar to the first layer 12. Alternatively, if an essentially impervious backing material 14 (such as metal foil) is used, a layer of adhesive 15 can be employed which will permit the hydrogen generated in the cell 11 to escape from the vents 25 and then pass laterally through the adhesive between the cell 11 and the foil backing material.

Regardless of which of the foregoing laminations is employed, it is important that the adhesive strip cleanly and completely from the cells 11 when they are removed from the apertures 13. This not only insures that the terminal of the cell has good electrical contact characteristics, but also, obviates the problem of accidental blockage of the vent holes 25 with adhesive material.

From the foregoing it will be appreciated that the package 10 is a simple and convenient storage and merchandising device for button cells 11. While in its preferred form the package 10 also incorporates barrier properties for the storage of Zinc-Air cells, it will be appreciated that the package 10 is also a handy and appealing storage and display container for other button cells such as those of the Nickel-Cadmium and Zinc-Mercuric Oxide and Zinc-Silver Oxide types. The cover 16 not only protects the cells 11 from accidental electrical storage but also from physical dislodgment from the package 10. Additionally, the materials of the package 10 including the first layer 12, the backing material 14 and/or the cover may be formed of absorbent material or impregnated with an electrolyte neutralizing agent to prevent electrolyte leakage from the cells from damaging other packages, display or storage devices.

I claim as my invention:

1. A storage and merchandising package for button cells which have at least one vent hole in one end thereof comprising in combination a substantially flat first layer of material having one or more apertures therein dimensioned to receive respective ones of said button cells, and a second layer of backing material laminated to the first layer and having exposed adhesive thereon in the areas underlying said apertures releasably retaining said button cells in said apertures with said one end in contact with said adhesive and said vent hole covered thereby, said first layer being relatively rigid to thereby stiffen said second layer and substantially preclude warpage thereof which tends to separate said exposed adhesive from said button cells and said second layer of material and said adhesive thereon covering said vent hole permitting the passage of hydrogen therethrough but being substantially impermeable to the passage of oxygen, carbon dioxide and water vapor.

2. A package as defined in claim 1 including a cover secured to said first layer and having a front panel folded back from one end of said first layer in overlying relation thereto and means for releasably anchoring a free edge of said front panel adjacent the opposite end of said first layer so as to substantially eliminate accidental physical dislodgment of said button cells from said apertures.

3. A package as defined in claim 2 wherein said cover includes a back panel folded back from said one end in underlying relation to said second layer and said anchoring means includes a portion of said back panel reversely folded over said first layer at said opposite end to receive said free edge of said front panel.

4. A pacakage as defined in claim 3 wherein said first layer includes a portion at said opposite end reversely folded over in the same direction as, but shorter than, said reversely folded over back panel portion to form a slot-like recess for reception of said free edge of said front panel.

5. A package as defined in claim 2 wherein said cover carries identifying indicia thereon.

6. A package as defined in claim 2 wherein at least one of said first layer, second layer and cover is made of an absorbent material.

7. A package as defined in claim 2 wherein at least one of said first layer, second layer and cover is made of a material impregnated with an electrolyte neutralizing agent.

8. A package as defined in claim 1 wherein said adhesive has greater adhesion to said second layer than to said button cells so that said adhesive strips cleanly from said cells when they are removed from said apertures.

9. A package as defined in claim 1 including a cover secured to said first layer and having a front panel folded back from one end of said first layer in overlying relation thereto and means for releasably anchoring a free edge of said front panel adjacent the opposite end of said first layer so as to substantially eliminate accidental shorting of said cells.

* * * * *